US007998313B2

(12) United States Patent
Kokko

(10) Patent No.: US 7,998,313 B2
(45) Date of Patent: Aug. 16, 2011

(54) INFLATED FIBERS OF REGENERATED CELLULOSE FORMED FROM IONIC LIQUID/CELLULOSE DOPE AND RELATED PRODUCTS

(75) Inventor: Bruce J. Kokko, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 88 days.

(21) Appl. No.: 11/983,318

(22) Filed: Nov. 8, 2007

(65) Prior Publication Data

US 2008/0135193 A1 Jun. 12, 2008

Related U.S. Application Data

(60) Provisional application No. 60/873,356, filed on Dec. 7, 2006.

(51) Int. Cl.
*D21H 11/00* (2006.01)

(52) U.S. Cl. ..... 162/157.1; 162/157.6; 162/157.7; 264/41; 264/43; 264/48; 264/50; 264/55

(58) Field of Classification Search ..... 162/157.1, 162/157.6, 157.7
See application file for complete search history.

(56) References Cited

U.S. PATENT DOCUMENTS

| | | | | | |
|---|---|---|---|---|---|
| 3,156,605 | A | | 11/1964 | Anderer et al. | 161/169 |
| 3,508,941 | A | | 4/1970 | Johnson | 106/125 |
| 3,764,428 | A | * | 10/1973 | Oshima et al. | 156/78 |
| 3,994,771 | A | | 11/1976 | Morgan, Jr. et al. | 162/113 |
| 4,102,737 | A | | 7/1978 | Morton | 162/113 |
| 4,129,679 | A | * | 12/1978 | Woodings | 428/398 |
| 4,130,689 | A | * | 12/1978 | Costa, Jr. | 428/398 |
| 4,246,221 | A | | 1/1981 | McCorsley, III | 264/203 |
| 5,124,197 | A | * | 6/1992 | Bernardin et al. | 442/35 |
| 5,607,551 | A | | 3/1997 | Farrington, Jr. et al. | 162/109 |
| 6,129,867 | A | * | 10/2000 | Chevalier et al. | 264/28 |
| 6,187,137 | B1 | | 2/2001 | Druecke et al. | 162/109 |
| 6,235,150 | B1 | | 5/2001 | Middleton et al. | 162/9 |
| 6,573,405 | B1 | | 6/2003 | Abbott et al. | 564/292 |
| 6,808,557 | B2 | | 10/2004 | Holbrey et al. | 106/163.01 |
| 6,900,313 | B2 | | 5/2005 | Wasserscheid et al. | 544/59 |
| 7,053,232 | B2 | | 5/2006 | Mouton | 556/174 |
| 2003/0157351 | A1 | | 8/2003 | Swatloski et al. | 428/478.4 |
| 2004/0009205 | A1 | * | 1/2004 | Sawhney | 424/423 |
| 2004/0038031 | A1 | * | 2/2004 | Holbrey et al. | 428/402.24 |
| 2005/0121157 | A1 | | 6/2005 | Doelle et al. | 162/9 |
| 2005/0186247 | A1 | * | 8/2005 | Hunter et al. | 424/423 |
| 2005/0288484 | A1 | | 12/2005 | Holbrey et al. | 528/480 |
| 2006/0090271 | A1 | * | 5/2006 | Price et al. | 8/490 |
| 2006/0113051 | A1 | | 6/2006 | Dolle | 162/181.2 |
| 2006/0207722 | A1 | | 9/2006 | Amano et al. | 156/327 |
| 2006/0240727 | A1 | | 10/2006 | Price et al. | 442/59 |
| 2006/0240728 | A1 | | 10/2006 | Price et al. | 442/59 |
| 2006/0241287 | A1 | | 10/2006 | Hecht et al. | 530/356 |

OTHER PUBLICATIONS

J. Amer. Chem. Soc. (2002) 124, article at 4974; Macromolecules (2005), 38, article at 8272; Macromol. Biosci. (2005), 5, article at 520; and Biomacromolecules (2004), 5, article at 1379.

* cited by examiner

*Primary Examiner* — Eric Hug
*Assistant Examiner* — Jacob Thomas Minskey
(74) *Attorney, Agent, or Firm* — Laura L. Bozek

(57) ABSTRACT

Inflated fibers of regenerated cellulose and other regenerated structures are formed from ionic liquid/cellulose dope. Fibers so produced may be incorporated into absorbent sheet with other papermaking fibers to provide softness, bulk and absorbency.

16 Claims, 5 Drawing Sheets
(5 of 5 Drawing Sheet(s) Filed in Color)

FIBER WITH $CaCO_3$ (50x)

FIBER WITH $CaCO_3$ (50x)

$CaCO_3$ POWDER (100x)

FIBER WITH $CaCO_3$ POWDER (100x)

FIBER WITH $CaCO_3$ DURING HCl ADDITION (50x)

INFLATED FIBER AFTER HCl ADDITION (50x)

INFLATED FIBERS OF REGENERATED CELLULOSE FORMED FROM IONIC LIQUID/CELLULOSE DOPE AND RELATED PRODUCTS

CLAIM FOR PRIORITY

This non-provisional application is based upon U.S. Provisional Patent Application Ser. No. 60/873,356, of the same title, filed Dec. 7, 2006. The priority of U.S. Provisional Patent Application Ser. No. 60/873,356 is hereby claimed and the disclosure thereof is incorporated into this application by reference.

TECHNICAL FIELD

The present invention relates to inflated structures of regenerated cellulose, such as fibers or films. Fibers are regenerated from an ionic liquid/cellulose dope having dispersed therein an effervescing agent such that the effervescing agent is encapsulated within a regenerated cellulosic matrix. Upon activation of the effervescing agent, a gas is generated in-situ within the matrix to form an inflated structure.

BACKGROUND

Regenerated cellulose is a robust, cost effective material which would likely be more widely used if inflated structures of regenerated cellulose could be readily produced without the drawbacks of prior art methods of making such products.

Regenerated cellulose, sometimes referred to as semi-synthetics or cellulosics, are well-known in the art. Rayon is made by way of the viscose process which involves reacting cellulose with a concentrated solution of sodium hydroxide to form soda cellulose followed by reacting the soda cellulose with carbon disulfide to form sodium cellulose xanthate. The sodium cellulose xanthate is dissolved in a dilute solution of sodium hydroxide to give a viscose solution which is aged and then extruded through spinerettes into dilute sulfuric acid, which regenerates the cellulose in the form of continuous filaments. Cellulose acetate and triacetate products are produced from a dope of cellulose acetate dissolved in acetone and/or a chlorinated hydrocarbon. Lyocell products are made from cellulose dissolved in N-methylmorpholine N-oxide (NMMO). See U.S. Pat. No. 4,246,221 of McCorsley et al., as well as U.S. Pat. No. 3,508,941 of Johnson. Degradation of the cellulose polymer, reactive chemical species in the dopes, high temperatures, harsh conditions and solvent disposal are significant processing issues with these products, making it extremely difficult to manufacture inflated cellulosic products utilizing conventional cellulosic technology.

Nevertheless, methods of making inflated textile fibers from, for example, viscose rayon, are known in the art. Various methods are reviewed in a 1985 non-wovens symposium paper entitled "The Manufacture, Properties and Uses of Inflated Viscose Rayon Fibers" authored by Woodings et al. U.S. Pat. No. 3,156,605 to Anderer et al. discloses producing inflated rayon fibers from viscose having nitrogen emulsified therein, while GB Patent 244,446 discloses the manufacture of flat ribbon-shaped artificial textile fibers which are more or less hollow from viscose with sodium carbonate or sodium bicarbonate. Also noted is U.S. Pat. No. 5,124,197 of Bernardin et al. entitled "Inflated Cellulosic Fiber Web Possessing Improved Vertical Wicking Properties". This patent reports that an absorbent web formed from inflated cellulose fibers possesses improved vertical wicking properties compared to a similar web of cellulose fibers. The webs are reported useful for use in forming absorbent products such as diapers and the like.

U.S. Pat. No. 6,808,557 to Holbrey et al. entitled "Cellulose Matrix Encapsulation and Method" discloses a regenerated cellulose with encapsulated active substance such as dyes or magnetic particles within a matrix of regenerated cellulose prepared from an ionic liquid/cellulose solution. The regenerated cellulose has a molecular weight similar to the original cellulose and is prepared substantially free of substituent groups relative to the starting cellulose. The '557 patent notes in Col. 13 that engineered forms containing impregnated additives with enhanced properties and application can be prepared from ionic liquid solution. Specific additives mentioned include bioactive agents, metal complexants, water insoluble dyes, nanoparticles, photonic agents, UV screens, magnetic particles and dispersions of clays. Note also, U.S. patent application Ser. No. 11/087,496; Publication No. US 2005/0288484 to Holbrey et al. entitled "Polymer Dissolution and Blend Formation in Ionic Liquids", as well as U.S. patent application Ser. No. 10/394,989; Publication No. US 2004/0038031 to Holbrey et al. entitled "Cellulose Matrix Encapsulation and Method".

Calcium carbonate has been used as a filler for making high strength paper. For example, there is disclosed in U.S. Pat. No. 6,235,150 to Middleton et al. a method for attaining high levels of loading of calcium carbonate fillers in the lumens of naturally-derived wood pulp fibers. The pulp is pretreated with a cationic polymer prior to being impregnated with the filler. Different conditions of pH and temperature are specified depending on whether the filler is a precipitated calcium carbonate filler or a ground calcium carbonate. Another method for providing calcium carbonate into a fibrous matrix involves supplying a precursor and then treating impregnated fibers with carbon dioxide. See U.S. patent application Ser. No. 10/927,890, Publication No. US 2005/0121157 of Doelle et al., as well as U.S. patent application Ser. No. 10/543,191, Publication No. US 2006/0113051 of Dolle. Wood pulp fibers are not amenable to inflation with an effervescing agent such as calcium carbonate due to their porosity.

It has been found in accordance with the present invention that inflated cellulose structures are readily formed from an ionic liquid/cellulose dope which has been impregnated with an effervescing agent and regenerated into the desired structure.

SUMMARY OF INVENTION

Ionic liquids such as 1-butyl-3-methylimidazolium chloride or 1-allyl-3-methylimidazolium chloride (AMIm), which dissolve cellulose under mild conditions, without reacting with or degrading the cellulose, makes it possible to efficiently encapsulate calcium carbonate or other effervescing agent in regenerated cellulose. The calcium carbonate, so entrapped, is used to create carbon dioxide from within fibers that modifies the fiber structure. Such modification can yield bulking/absorbent fibers for tissue production (or similarly) other articles such as porous films and so forth as discussed herein. Conventional cellulose dissolution technologies, such as xanthanation or dissolving in N-methylmorpholine oxide, do not lend themselves to this approach.

There is thus provided in accordance with the invention a method of making an inflated article of regenerated cellulose such as a fiber or film. The method involves generally: (a) preparing a cellulosic dope comprising cellulose dissolved in a suitable ionic liquid or quasi-ionic liquid; (b) dispersing an effervescing agent in the cellulosic dope, the effervescing agent and ionic liquid or quasi-ionic liquid being selected such that they are substantially inert with respect to each other; and (c) regenerating the cellulosic dope into a shaped article such as a fiber or a film. The fiber or film comprises a regenerated cellulose matrix having dispersed therein substantially unreacted effervescing agent encapsulated by the regenerated cellulose matrix. The encapsulated effervescing agent is then activated to generate gas in-situ within the regenerated cellulose matrix and create a shaped article with an inflated structure. Any suitable ionic liquid or quasi-ionic liquid may be employed. In one preferred aspect of the invention, imidazolium salts are used such as 1-allyl-3-methylimidazolium chloride or 1-butyl-3-methylimidazolium chloride or 1-ethyl-3-methylimidazolium acetate. The effervescing agent may be powdered or particulate carbonate salts such as calcium carbonate, sodium carbonate, or sodium bicarbonate. The effervescing agent may be activated by contacting the shaped article with an aqueous acid, for example, or the effervescing agent may be selected such that it is water-activated. Suitable acids for acid activated effervescing agents include mineral acids and organic acids such as citric acid, acetic acid, trichloroacetic acid, oxalic acid, malonic acid, maleic acid, lactic acid, glycolic acid, formic acid, benzoic acid, fumaric acid, malic acid or tartaric acid.

Preferably the effervescing agent is selected and the step of activating the encapsulated effervescing agent is carried out to completion such that the shaped article with an inflated structure is substantially bereft of an encapsulated effervescing agent. The cellulosic dope may be regenerated with water or regenerated with an aqueous surfactant or other additive to control the size of the regenerated article.

In another aspect of the invention, there is provided a shaped article of regenerated cellulose having encapsulated effervescing agent capable of generating a gas in-situ upon activation which provides an inflated structure to the shaped article. The shaped article is prepared by way of regenerating a cellulosic dope comprising cellulose dissolved in a suitable ionic liquid or quasi-ionic liquid with the effervescing agent dispersed therein. The encapsulated effervescing agent may be activated to provide an inflated structure having an internal pore volume of from 5% to 50%. In a preferred aspect of the invention the inflated structure has an internal pore volume of at least 10%.

Fibers of the invention are particularly useful when mixed with other papermaking fibers in connection with the manufacture of wet-laid absorbent sheet. The fibers of the invention may be mixed with pulp-derived papermaking fiber such as Kraft hardwood fiber or Kraft softwood fiber or recycle fiber.

Typical products have a basis weight of from about 5 lbs/3000 $ft^2$ ream to about 50 lbs/3000 $ft^2$ ream. In many cases the product will have a basis weight of from about 7.5 lbs/3000 $ft^2$ ream to about 35 lbs/3000 $ft^2$ ream.

Further details and aspects of the present invention are described in more detail below.

BRIEF DESCRIPTION OF DRAWINGS

The file of this patent contains at least one drawing executed in color. Copies of this patent with color drawings(s) will be provided the Patent and Trademark Office upon request and payment of the necessary fee.

The invention is described with reference to the drawings, wherein.

DETAILED DESCRIPTION

Figure 1:
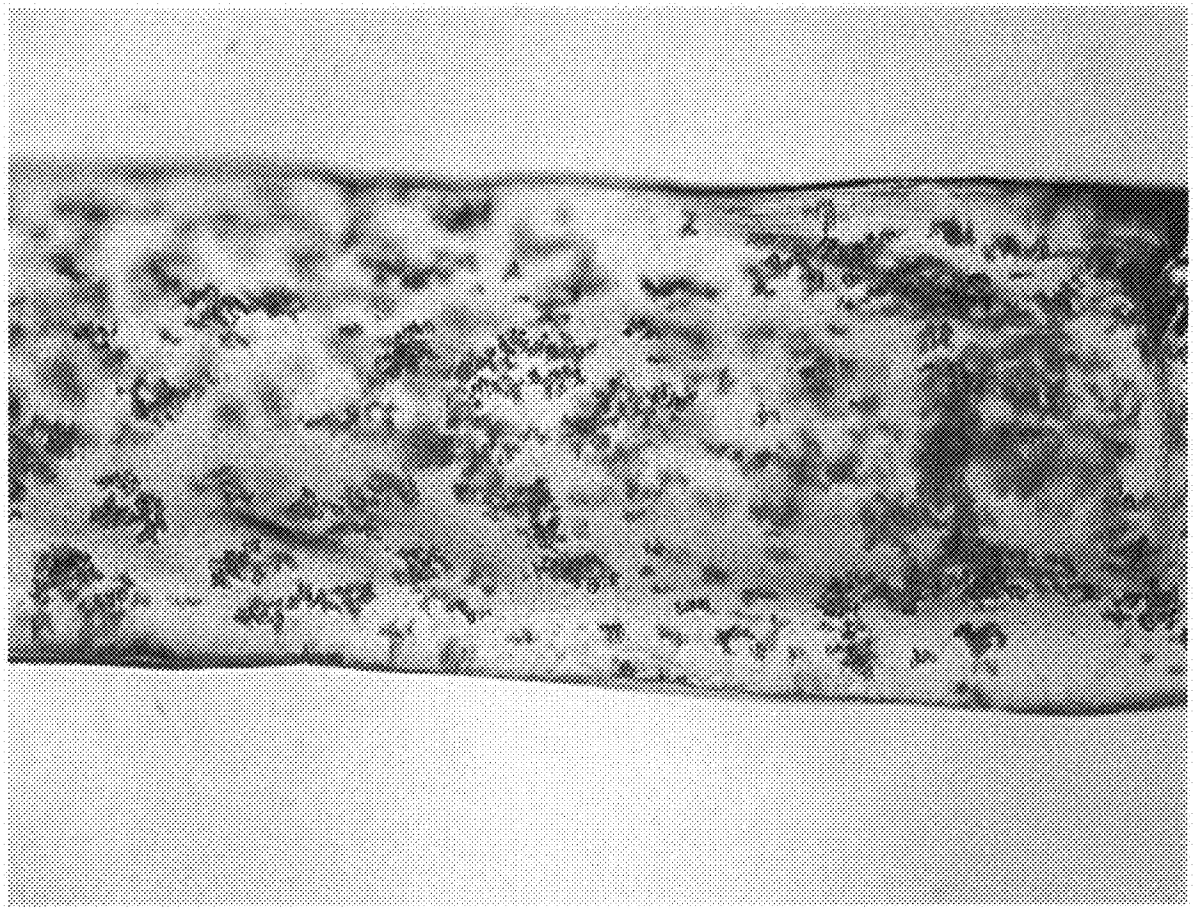
FIG. 1 is a photomicrograph showing a fiber of regenerated cellulose containing calcium carbonate (50×)

The invention is described in detail below with reference to several embodiments. Such discussion is for purposes of illustration only.

Terminology used herein is given its ordinary meaning consistent with the exemplary definitions set forth immediately below; mg refers to milligrams and $m^2$ refers to square meters, mBar means milliBar (1/1000 Bar) and so forth. Unless otherwise specified, % means weight percent.

Unless otherwise specified, "basis weight", BWT, bwt and so forth refers to the weight of a 3000 square foot ream of product. Consistency refers to percent solids of a nascent web, for example, calculated on a bone dry basis. "Air dry" means including residual moisture, by convention up to about 10 percent moisture for pulp and up to about 6% for paper. A nascent web having 50 percent water and 50 percent bone dry pulp has a consistency of 50 percent.

The term "cellulosic", "cellulosic sheet" and the like is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood Kraft fibers; hardwood fibers, such as eucalyptus, maple, birch, aspen, or the like. Papermaking fibers used in connection with the invention are typically naturally occurring pulp-derived fibers (as opposed to reconstituted fibers such as lyocell or rayon) which are liberated from their source material by any one of a number of pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide and so forth. Naturally occurring pulp-derived fibers are referred to herein simply as "pulp-derived" papermaking fibers. The products of the present invention may comprise a blend of conventional fibers (whether derived from virgin pulp or recycle sources) and high coarseness lignin-rich tubular fibers, such as bleached chemical thermomechanical pulp (BCTMP). Pulp-derived fibers thus also include high yield fibers such as BCTMP as well as thermomechanical pulp (TMP), chemithermomechanical pulp (CTMP) and alkaline peroxide mechanical pulp (APMP). "Furnishes" and like terminology refers to aqueous compositions including papermaking fibers, optionally wet strength resins, debonders and the like for making paper products. The papermaking fibers are in many embodiments Kraft fibers, described below.

Kraft softwood fiber is low yield fiber made by the well known Kraft (sulfate) pulping process from coniferous material and includes northern and southern softwood Kraft fiber, Douglas fir Kraft fiber and so forth. Kraft softwood fibers generally have a lignin content of less than 5 percent by weight, a length weighted average fiber length of greater than 2 mm, as well as an arithmetic average fiber length of greater than 0.6 mm.

Kraft hardwood fiber is made by the Kraft process from hardwood sources, i.e., eucalyptus and also has generally a lignin content of less than 5 percent by weight. Kraft hardwood fibers are shorter than softwood fibers, typically having a length weighted average fiber length of less than 1 mm and an arithmetic average length of less than 0.5 mm or less than 0.4 mm.

"Cellulosic dope" means a viscous solution of dissolved cellulose.

"Denier" is a measure of fiber or filament coarseness and is in units of g/9000 m unless otherwise indicated.

Freezing point depressions of compositions are determined by calculating the melting point by rule of mixtures and subtracting the observed melting point of the composition.

The effervescing agent is any suitable, usually particulate, substance capable of generating a gas when activated. Activation may be made with water or an aqueous acid, for example, depending on the effervescing agent employed. Acid-activated effervescing agents include ammonium, alkali metal, and alkaline earth metal carbonates, bicarbonates, sesquicarbonates and the like. Water-activated effervescing agents typically include both an acid and a base component which react upon wetting with water to release a gas. Suitable effervescing agents are readily selected for use in connection with the present invention.

"Fiber" means an elongated fibrous structure, typically having an aspect (length/diameter) ratio of 3 or more.

"Film" generally refers to a structure which has a length and a width much greater than its thickness.

"Inflated structure" refers to structure having substantial internal void volume. Without intending to be bound by theory or mechanism, inflated structure may be created by removal of encapsulated effervescing agent as it decomposes into gas thus "hollowing" the structure; and/or inflated structure may be created by way of gas generated in-situ expanding the surrounding matrix. Both effects are believed to contribute to rendering the article porous in typical embodiments.

"Internal pore volume" is expressed in percent and is the volume fraction of void space within a fiber, film, or other product including void space generated by the effervescing agent, times 100%. Internal pore volume may be measured by any suitable technique including optical techniques or liquid intrusion under pressure.

Methods of making paper tissue, towel, and the like are well known, including various features such as Yankee drying, throughdrying, fabric creping, dry creping, wet creping and so forth. Conventional wet pressing/dry creping processes (CWP) have certain advantages over conventional through-air drying processes including: (1) lower energy costs associated with the mechanical removal of water rather than transpiration drying with hot air; and (2) higher production speeds which are more readily achieved with processes which utilize wet pressing to form a web. On the other hand, through-air drying processing has been widely adopted for new capital investment, particularly for the production of soft, bulky, premium quality tissue and towel products.

Throughdried, creped products and processes (TAD) are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively permeable web is typically required, making it difficult to employ recycle furnish at levels which may be desired. Transfer to the Yankee typically takes place at web consistencies of from about 60% to about 70%. See also, U.S. Pat. No. 6,187,137 to Druecke et al. which includes disclosure of peeling a web from a Yankee dryer. Uncreped, throughdried products are described in U.S. Pat. No. 5,607,551, to Farrington, Jr. et al., the disclosure of which is incorporated herein by reference.

Some newer processes including fabric-creping and the use of creping adhesives are described in the following co-pending applications: U.S. application Ser. No. 10/679,862 (Publication No. US 2004/0238135), entitled "Fabric Crepe Process for Making Absorbent Sheet" which application, incorporated herein by reference, discloses particular papermachine details as well as creping techniques, equipment and properties; U.S. application Ser. No. 11/108,375(Publication No. US 2005/0217814), entitled "Fabric Crepe/Draw Process for Producing Absorbent Sheet" also incorporated herein by reference, provides still further processing and composition information; U.S. application Ser. No. 11/108,458(Publication No. US 2005/0241787), entitled "Fabric Crepe and In Fabric Drying Process for Producing Absorbent Sheet" and U.S. application Ser. No. 11/104,014(Publication No. US 2005/0241786), entitled "Wet-Pressed Tissue and Towel Products With Elevated CD Stretch and Low Tensile Ratios Made With a High Solids Fabric Crepe Process", both of which are incorporated herein by reference, provide some further variation as to selection of components and processing techniques. Another co-pending application, U.S. Ser. No. 11/451,111(Publication No. US 2006/0289134), entitled "Method of Making Fabric-Creped Sheet for Dispensers", incorporated herein by reference, provides information on suitable drying and other manufacturing techniques.

Details with respect to preparation of cellulosic dopes including cellulose and an ionic liquid and cellulose regeneration therefrom are found in U.S. patent application Ser. No. 10/256,521; Publication No. US 2003/0157351 to Swatloski et al. entitled "Dissolution and Processing of Cellulose Using Ionic Liquids", the disclosure of which is incorporated herein by reference. There is described generally in this patent a process for dissolving cellulose in an ionic liquid without derivatization and regenerating the cellulose in a range of structural forms. It is reported that the cellulose solubility and the solution properties can be controlled by the selection of ionic liquid constituents with small cations and halide or pseudohalide anions favoring solution. See also, the following publications, the disclosure of which is incorporated herein by reference: WO 05/098546; J. Amer. Chem. Soc. (2002) 124, article at 4974; Macromolecules (2005), 38, article at 8272; Macromol. Biosci. (2005), 5, article at 520; and Biomacromolecules (2004), 5, article at 1379.

With respect to ionic liquids in general the following documents provide further detail: U.S. patent application Ser. No. 11/406,620, Publication No. US 2006/0241287 to Hecht et al. entitled "Extracting Biopolymers From a Biomass Using Ionic Liquids"; U.S. patent application Ser. No. 11/472,724, Publication No. US 2006/0240727 to Price et al. entitled "Ionic Liquid Based Products and Method of Using The Same"; U.S. patent application Ser. No. 11/472,729; Publication No. US 2006/0240728 of Price et al. entitled "Ionic Liquid Based Products and Method of Using the Same"; and U.S. patent application Ser. No. 11/263,391, Publication No. US 2006/0090271 of Price et al. entitled "Processes For Modifying Textiles Using Ionic Liquids", the disclosures of which are incorporated herein by reference.

"Ionic liquid", refers to a molten composition including an ionic compound that is preferably a stable liquid at temperatures of less than 100° C. at ambient pressure. Typically, such liquids have very low vapor pressure at 100° C., less than 75 mBar or so and preferably less than 50 mBar or 25 mBar at 100° C. Most suitable liquids will have a vapor pressure of less than 10 mBar at 100° C. and often the vapor pressure is so low it is negligible and is not easily measurable since it is less than 1 mBar at 100° C. The liquids may be a single compound, may include simple mixtures of two or more compounds, and optionally include reaction or decomposition products formed in-situ. Ionic liquids useful in connection with the present invention may be prepared by combining two or more individual component compounds, which are usually solid under ambient conditions, mixing them together and heating until they melt. The mixture remains a liquid upon cooling, preferably at least to 100° C. Still more preferably, the ionic liquids used in connection with the invention have melting points of less than 75° C., or less than 50° C., and most preferably are liquid at 25° C. Ionic liquids based on mixtures of two or more compounds useful in connection with the present invention typically exhibit significant freezing point depressions as compared with the rule of mixtures melting point of the constituent compounds. Preferred ionic liquids exhibit a freezing point depression of at least 25° C., preferably 75° C., and more preferably at least 150° C., based on the melting points and amounts of the individual components.

Ionic liquids as such are well known, and may be formed by complexing one or more organic cations from an organic salt, with a large metal anion and/or an organic anion from another salt compound. Some organic cations may also form ionic liquids with relatively simple anions such as halides, nitrates, sulfates, or the like. One or both of the anion or cation components in the ionic liquid may be large and asymmetrical, which promotes lower freezing points presumably because it is more difficult for the ions to fit into a solid lattice structure. Potentially useful ionic liquids may also be prepared by combining an organic salt with a hydrogen bond donating agent such as urea or a carbohydrate (e.g., a saccharide) where the hydrogen bond donor generally complexes with the anion of the organic salt, thus lowering the melting point of the composition.

Suitable ionic liquids are disclosed in U.S. patent application Ser. No. 11/375,963 of Amano et al. (Publication No. 2006/0207722), the disclosure of which is incorporated herein by reference. These ionic liquids include an onium cation and suitable anion. Typical cations include those of the following general structures:

Structure I

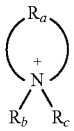

-continued

Structure II

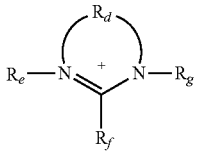

Structure III

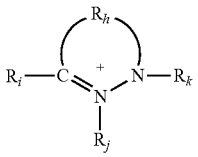

Structure IV

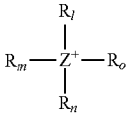

In the formula Structure I, $R_a$ represents a hydrocarbon group of a carbon number of 4 to 20, and may contain a hetero atom, and $R_b$ and $R_c$ are the same or different, represent hydrogen or a hydrocarbon group of a carbon number of 1 to 16, and may contain a hetero atom, provided that, when a nitrogen atom has a double bond, $R_c$ is not present.

In the formula Structure II, $R_d$ represents a hydrocarbon group of a carbon number of 2 to 20, and may contain a hetero atom, and $R_e$, $R_f$ and $R_g$ are the same or different, represent hydrogen or a hydrocarbon group of a carbon number of 1 to 16, and may contain a hetero atom.

In the formula Structure III, $R_h$ represents a hydrocarbon group of a carbon number of 2 to 20, and may contain a hetero atom, and $R_i$, $R_j$ and $R_k$ are the same or different, represent a hydrogen or a hydrocarbon group of a carbon number of 1 to 16, and may contain a hetero atom.

In the formula Structure IV, Z represents a nitrogen atom, a sulfur atom, or a phosphorus atom, and $R_l$, $R_m$, $R_n$ and $R_o$ are the same or different, represent a hydrogen atom or a hydrocarbon group of a carbon number of 1 to 20, and may contain a hetero atom, provided that, when Z is a sulfur atom, $R_c$ is not present. Specific compounds are enumerated in the '963 application. Suitable cations useful in ionic liquids include the following cations in substituted or unsubstituted form: ammonium; guanidium; pyridinium; pyridazinium; pyrimidinium; pyrazinium; imidazolium; pyrazolium; oxazolium; uronium; thiouronium; 1,2,3-triazolium; 1,2,4-triazolium; thiazolium; piperidinium; pyrrolidinium; quinolinium; and isoquinolinium.

Suitable commercially available ionic liquids are Basionic™ ionic liquid products available from BASF (Florham Park, N.J.) and are listed in Table 1 below.

TABLE 1

Exemplary Ionic Liquids

| IL Abbreviation | Basionic ™ Grade | Product name | CAS Number |
|---|---|---|---|
| | | STANDARD | |
| EMIM Cl | ST 80 | 1-Ethyl-3-methylimidazolium chloride | 65039-09-0 |
| EMIM $CH_3SO_3$ | ST 35 | 1-Ethyl-3-methylimidazolium methanesulfonate | 145022-45-3 |
| BMIM Cl | ST 70 | 1-Butyl-3-methylimidazolium chloride | 79917-90-1 |

TABLE 1-continued

| Exemplary Ionic Liquids | | | |
|---|---|---|---|
| IL Abbreviation | Basionic ™ Grade | Product name | CAS Number |
| BMIM $CH_3SO_3$ | ST 78 | 1-Butyl-3-methylimidazolium methanesulfonate | 342789-81-5 |
| MTBS | ST 62 | Methyl-tri-n-butylammonium methylsulfate | 13106-24-6 |
| MMMPZ $MeOSO_3$ | ST 33 | 1,2,4-Trimethylpyrazolium methylsulfate | |
| EMMIM $EtOSO_3$ | ST 67 | 1-Ethyl-2,3-di-methylimidazolium ethylsulfate | 516474-08-01 |
| MMMIM $MeOSO_3$ | ST 99 | 1,2,3-Trimethyl-imidazolium methylsulfate | 65086-12-6 |
| | | ACIDIC | |
| HMIM Cl | AC 75 | Methylimidazolium chloride | 35487-17-3 |
| HMIM $HSO_4$ | AC 39 | Methylimidazolium hydrogensulfate | 681281-87-8 |
| EMIM $HSO_4$ | AC 25 | 1-Ethyl-3-methylimidazolium hydrogensulfate | 412009-61-1 |
| EMIM $AlCl_4$ | AC 09 | 1-Ethyl-3-methylimidazolium tetrachloroaluminate | 80432-05-9 |
| BMIM $HSO_{4</}$ | AC 28 | 1-Butyl-3-methylimidazolium hydrogensulfate | 262297-13-2 |
| BMIM $AlCl_4$ | AC 01 | 1-Butyl-3-methylimidazolium tetrachloroaluminate | 80432-09-3 |
| | | BASIC | |
| EMIM Acetat | BC 01 | 1-Ethyl-3-methylimidazolium acetate | 143314-17-4 |
| BMIM Acetat | BC 02 | 1-Butyl-3-methylimidazolium acetate | 284049-75-8 |
| | | LIQUID AT RT | |
| EMIM $EtOSO_3$ | LQ 01 | 1-Ethyl-3-methylimidazolium ethylsulfate | 342573-75-5 |
| BMIM $MeOSO_3$ | LQ 02 | 1-Butyl-3-methylimidazolium methylsulfate | 401788-98-5 |
| | | LOW VISCOSITY | |
| EMIM SCN | VS 01 | 1-Ethyl-3-methylimidazolium thiocyanate | 331717-63-6 |
| BMIM SCN | VS 02 | 1-Butyl-3-methylimidazolium thiocyanate | 344790-87-0 |
| | | FUNCTIONALIZED | |
| COL Acetate | FS 85 | Choline acetate | 14586-35-7 |
| COL Salicylate | FS 65 | Choline salicylate | 2016-36-6 |
| MTEOA $MeOSO_3$ | FS 01 | Tris-(2-hydroxyethyl)-methylammonium methylsulfate | 29463-06-7 |

Cellulose dopes including ionic liquids having dissolved therein about 5% by weight underivatized cellulose are commercially available from Aldrich. These compositions utilize alkyl-methylimidazolium acetate as the solvent. It has been found that choline-based ionic liquids are not particularly suitable for dissolving cellulose. Ionic liquids or quasi ionic liquids which readily dissolve cellulose under mild conditions are referred to herein as suitable ionic liquids or quasi ionic liquids, it being recognized that not all ionic liquids or quasi ionic liquids will readily dissolve cellulose.

Other potentially useful ionic liquids and quasi-ionic liquids are disclosed by Konig et al., Chem. Commun. 2005, 1170-1172, the disclosure of which is incorporated herein by reference:

TABLE 2

| Stable melts of carbohydrates, urea and inorganic salts | | | |
|---|---|---|---|
| Melting points[a] | Carbohydrate | Urea | Salt |
| 65° C. | Fructose (60%)[b] | Urea (40%) | — |
| 67° C. | Sorbitol (70%) | Urea (20%) | $NH_4Cl$ (10%) |

TABLE 2-continued

| Stable melts of carbohydrates, urea and inorganic salts | | | |
|---|---|---|---|
| Melting points[a] | Carbohydrate | Urea | Salt |
| 73° C. | Maltose (50%) | DMU[c] (40%) | $NH_4Cl$ (10%) |
| 75° C. | Glucose (50%) | Urea (40%) | $CaCl_2$ (10%) |
| 75° C. | Mannose (30%) | DMU[c] (70%) | — |
| 77° C. | Sorbitol (40%) | DMU (60%) | — |
| 77° C. | α-Cyclodextrin (30%) | DMU[c] (70%) | — |
| 65° C. | Citric acid (40%) | DMU[c] (60%) | — |

[a]Melting points are at normal pressure in air.
[b]w/w percent of the compounds in the mixture.
[c]DMU = N,N-dimethylurea Compositions disclosed also include the following: Fructose/DMU(70:30); Maltose/DMU/$NH_4Cl$ (50:40:10); Lactose/DMU/$NH_4Cl$ (60:30:10); Mannitol/DMU/$NH_4Cl$ (50:40:10); Glucose/urea/$CaCl_2$(50:40:10); Sorbitol/DMU/$NH_4Cl$ (70:20:10); Citric acid/DMU (40:60); α-Cyclodextrin/DMU (30:70). The ratios given are weight ratios.

As will be appreciated from the foregoing, the ionic liquids employed may potentially be of the class where an organic salt or urea is mixed with a covalent organic compound, such as a sugar or the like. Without intending to be bound by theory, in many cases it is believed that the organic compound acts as a hydrogen bond-complexing agent which interacts with the anion of the salt or other organic compound to depress the freezing point of the mixture, thereby stabilizing the liquid state. Exemplary covalent compounds which potentially may be suitable components for the ionic liquids used in connection with the invention include: urea; dimethyl urea; allyl urea; thoiourea; triflouroacetic acid; trichloroacetic acid; citric acid; mandelic acid; valeric acid; tartaric acid; phenyl acetic acid; m-nitrobenzoic acid; glutamic acid, m-aminobenzoic acid, acetamide; salicylamide; benzamide; glyoxylic acid; benzoic acid; malonic acid; oxalic acid; benzyl alcohol; ethanediol; triethanolamine; 2-chloroethanol; vanillin, p-hydroxybenzaldehyde; (alkyl)phenols; glycerol; sugars such as fructose, sorbitol, glucose, or the like; amino compounds such as aniline, diaminoethane; 1,2-diaminopropane, and combinations thereof. Combinations of the foregoing covalent compounds are likewise useful in the LTILs employed. Moreover, it is seen in Table 1 above that stable, low melting liquids may be prepared from suitable organic compounds without ionic ingredients, for example, suitable mixtures of urea and fructose or suitable mixtures of urea and citric acid exhibiting the foregoing characteristics in terms of freezing point depression and vapor pressure. These liquids are referred to herein as low melting quasi-ionic liquids.

"Quasi-ionic liquids" refers to molten compositions that preferably form stable liquids at temperatures of less than 100° C. at ambient pressure. Typically, such liquids have very low vapor pressure at 100° C., less than 75 mbar or so and preferably less than 50 mBar or 25 mBar at 100° C. Most suitable quasi-ionic liquids will have a vapor pressure of less than 10 mBar at 100° C. and often the vapor pressure is so low it is negligible and is not easily measurable since it is less than 1 mBar at 100° C. These liquids are mixtures of two or more compounds, such as a urea/fructose mixture which remain liquid upon cooling, preferably at least to 100° C. Still more preferably, the low-melting quasi-organic liquids used in connection with the invention have melting points of less than 75° C. Low-melting quasi-organic liquids useful in connection with the present invention typically exhibit significant freezing point depressions as compared with the rule of mixtures melting point of the constituent compounds. Preferred low-melting quasi-organic liquids ionic liquids exhibit a freezing point depression of at least 25° C., preferably 75° C., and more preferably at least 150° C., based on the melting points and amounts of the individual components.

Still further details as to potentially suitable liquids are found in the following documents, the disclosures of which are incorporated by reference in their entireties: U.S. Pat. No. 7,053,232, issued May 30, 2006, entitled "Lewis Acid Ionic Liquids", to Moulton; U.S. Pat. No. 6,900,313, issued May 31, 2005, entitled "Chiral Ionic Liquids", to Wasserscheid et al.; and U.S. Pat. No. 6,573,405, issued Jun. 3, 2003, entitled "Ionic Liquids", to Abbott et al.

EXAMPLES

A 0.50 g aliquot of calcium carbonate was dispersed in 10.90 g of a 4.76 wt % solution of bleached southern softwood Kraft pulp in AMIm, (1-allyl-3-methylimidazolium chloride), which is a clear stable and viscous fluid at room temperature, that had been warmed to 80° C. The resultant dispersion was poured into 1 L of vigorously stirring deionized water at room temperature. The cellulose regenerated rapidly to form fibers and fibrous ribbons, which were washed by filtering and re-slurrying in 1 L fresh D.I. water and then repeating this process two more times. The resultant fibers are depicted in FIG. 1 and clearly contain calcium carbonate particles.

Figure 2:
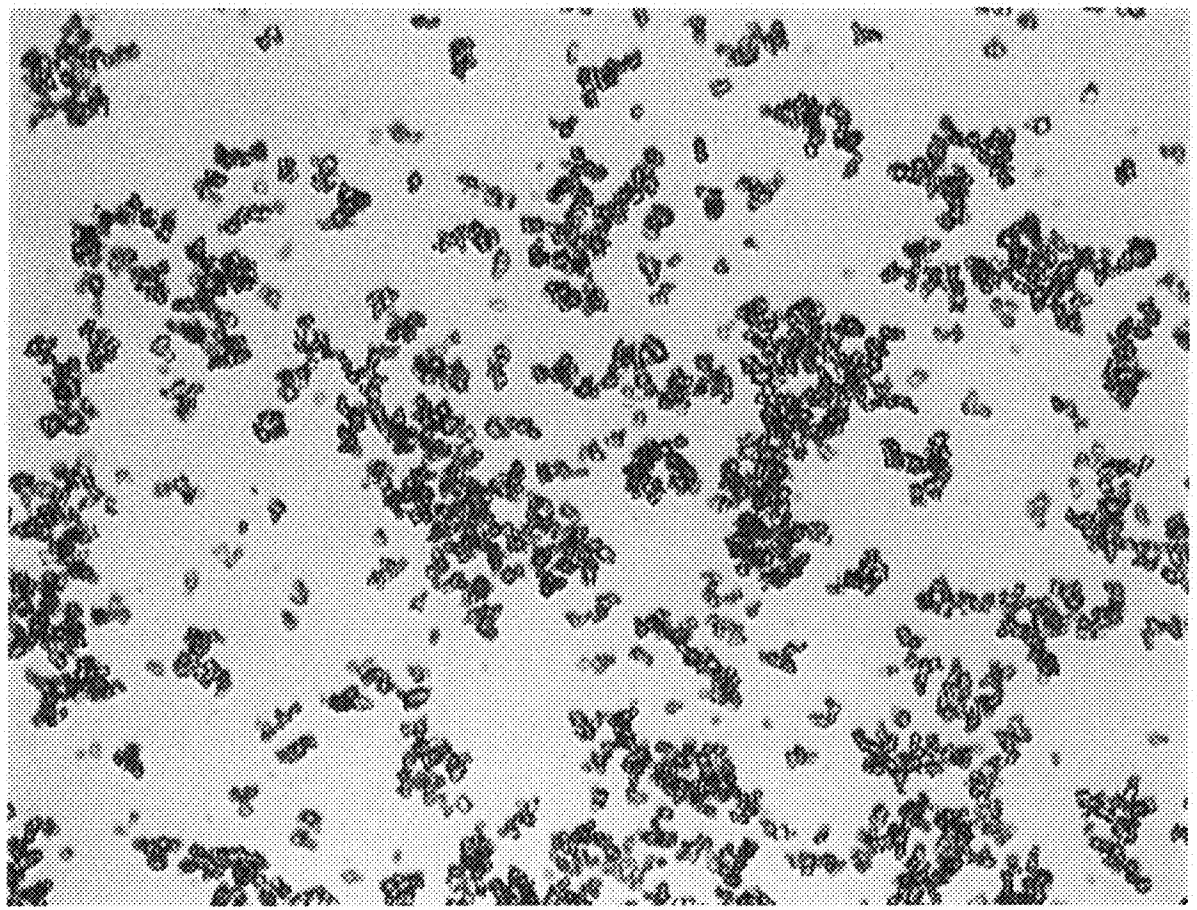
FIG. 2 is a photomicrograph of calcium carbonate powder (100×)
Figure 3:
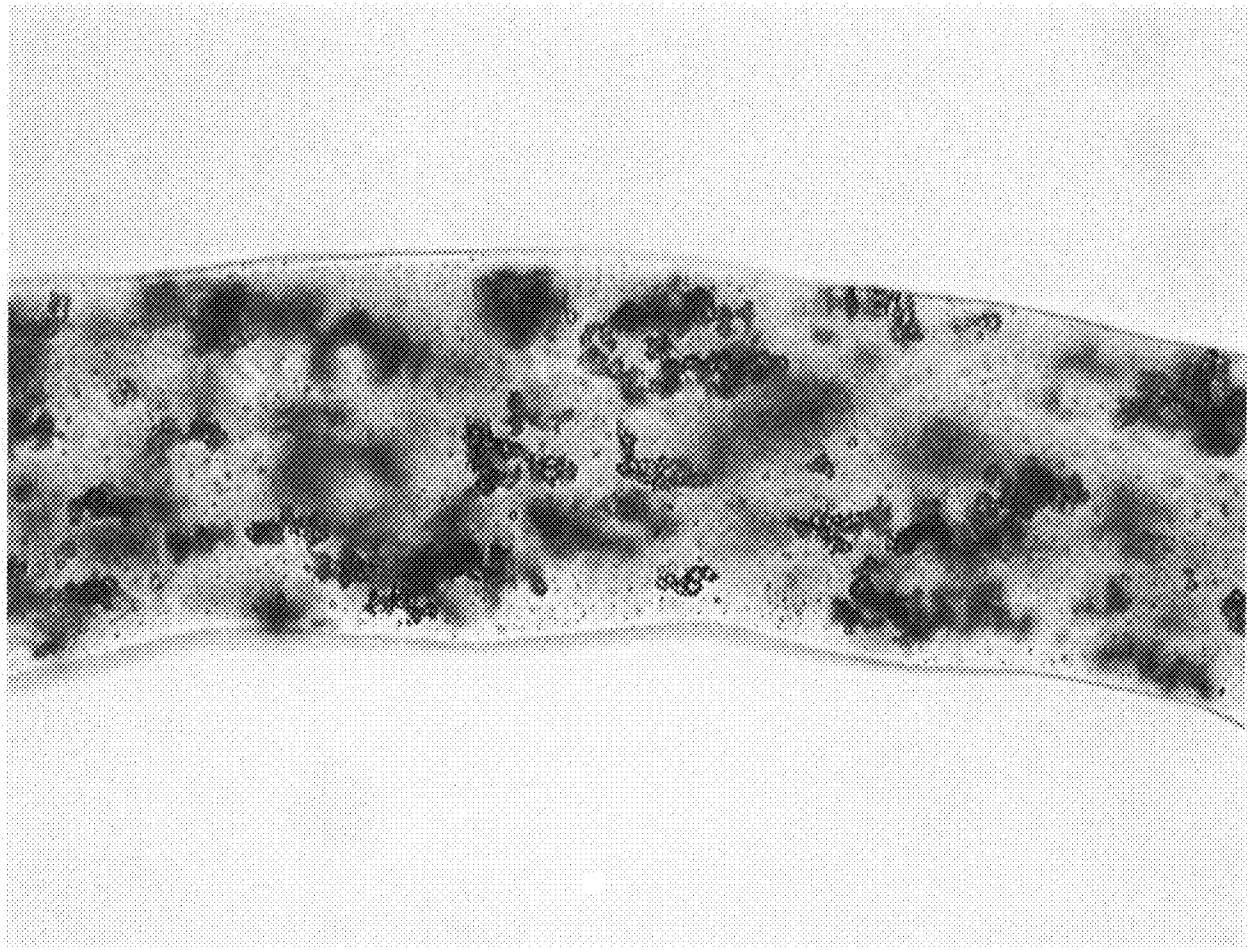
FIG. 3 is a photomicrograph regenerated fiber with encapsulated calcium carbonate (100×) which shows the encapsulated calcium carbonate has not been altered.

FIG. 2 is a photomicrograph showing the starting calcium carbonate while FIG. 3 shows a regenerated fiber containing the same calcium carbonate at the same magnification showing that the encapsulated calcium carbonate has not been altered in any way by the process, and is substantially unreacted.

Figure 4:
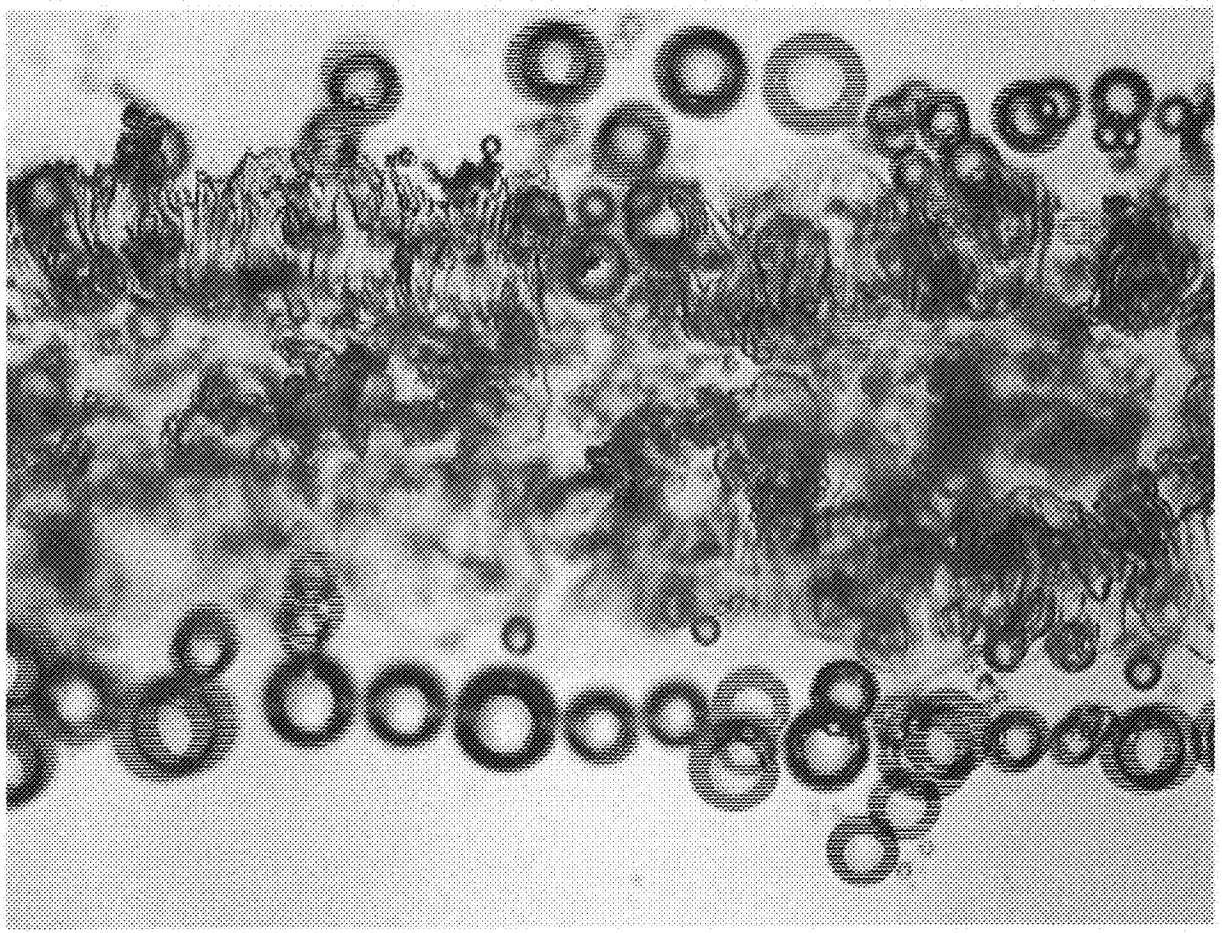
FIGS. 4 and 5 are photomicrographs of the fiber of FIGS. 1 and 3 during and after treatment with 1.0 N HCl solution showing the effects of effervescent of the encapsulated calcium carbonate on the fiber structures, that is, the eruption of $CO_2$ from the fiber surface. It is seen particularly in FIG. 5 that a porous flexible fiber, bereft of calcium carbonate particles was obtained.
Figure 5:
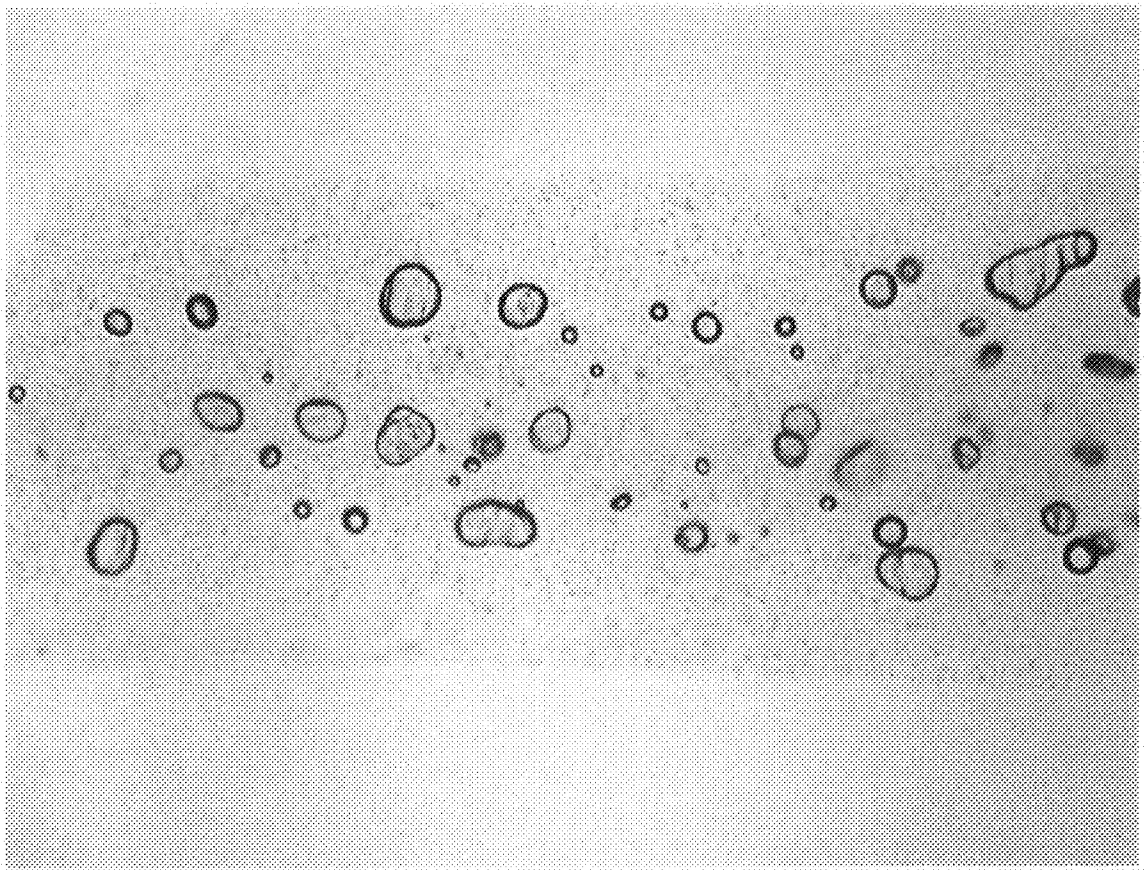

Treating the above fiber with a 1.0N HCl solution effects the desired internal effervescence and subsequent eruption of $CO_2$ from the surface of the fiber, as is shown in FIGS. 4 and 5. FIG. 4 shows a fiber during treatment, while FIG. 5 sows a fiber after treatment with HCl.

While not shown here, during effervescence, fracturing of the fiber surfaces occurred in some cases, and, in other substances, channels appeared within the fibers.

It was also demonstrated that size and structure of the regenerated cellulose can be controlled by the conditions of regeneration. Thus, regenerating the cellulose in a 1% aqueous dispersion of Incrosoft CFI-90PG at 80° C. created essentially particle-like cellulose structures. Using dispersion of 0.1% aqueous Incrosoft-90CFI-PG produced short regenerated fibers and fibrous ribbons. Thus, one can make effervesced regenerated cellulose structures to a range of sizes, depending on the requirements of the final application, by changing the method of regeneration.

The morphology of the regenerated calcium carbonate containing cellulose structures can also be altered by first drying the structures before initiating effervescence, or by drying the already-effervesced structures.

Surprisingly, the calcium carbonate, which is insoluble in water, stayed with the cellulose matrix and became encapsulated by the regenerated cellulose. It appeared that all of the added calcium carbonate was imbedded into the regenerated cellulose matrix.

The calcium carbonate/dissolved cellulose dispersion can, of course, be spun or film-formed to provide a raft of useful structures. For example, calcium carbonate containing spun fibers could be cut to a desired size and formed into a paper product—alone or with other fibers. Such a paper product might be useful for detecting acidic systems by effervescing upon exposure. One could cause effervescence to occur during sheet consolidation by spray applying an acid source onto the wet web on a paper machine to initiate in-situ foam forming to yield a soft, bulky, and absorbent substrate. Of course, the spun fibers can be effervesced, to alter their morphology, and then formed into paper—alone or with other fibers—to yield a soft, bulky, and absorbent substrate. Cast films of carbonate containing regenerated cellulose could be useful as barriers or membranes whose permeability could be changed on demand by adjusting pH. Any number of novelty or controlled release items can be conceived, where an object, food, or even medicine can be wrapped in the films of this invention and be safely, slowly or rapidly released or modified on demand by exposing the product to a mild acid solution.

While the invention has been described in detail, modifications within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

What is claimed is:

1. A method of making an inflated article of regenerated cellulose comprising:

(a) preparing a cellulosic dope comprising cellulose dissolved in a suitable ionic liquid or quasi-ionic liquid;

(b) dispersing an effervescing agent in the cellulosic dope, the effervescing agent and ionic liquid or quasi-ionic liquid being selected such that they are substantially inert with respect to each other;

(c) regenerating the cellulosic dope into a shaped article comprising a regenerated cellulose matrix having dispersed therein substantially unreacted effervescing agent encapsulated by the regenerated cellulose matrix; and (d) thereafter, activating the encapsulated effervescing agent to generate a gas in-situ within the regenerated cellulose matrix and create a shaped article with an inflated structure.

2. The method according to claim 1, wherein the shaped article with an inflated structure is a fiber with an inflated structure.

3. The method according to claim 1, wherein the shaped article with an inflated structure is a film with an inflated structure.

4. The method according to claim 1, wherein the cellulose dope comprises an ionic liquid which is an imidazolium salt.

5. The method according to claim 4, wherein the imidazolium salt is selected from: 1-allyl-3-methylimidazolium chloride; 1-butyl-3-methylimidazolium chloride; and 1-ethyl-3-methylimidazolium acetate.

6. The method according to claim 1, wherein the effervescing agent comprises a powdered carbonate salt.

7. The method according to claim 6, wherein the carbonate salt is calcium carbonate, sodium carbonate or sodium bicarbonate.

8. The method according to claim 1, wherein the effervescing agent is activated by contacting the shaped article with an acid.

9. The method according to claim 8, wherein the acid is a mineral acid.

10. The method according to claim 8, wherein the acid is an organic acid.

11. The method according to claim 10, wherein the organic acid is selected from citric acid, acetic acid, trichloroacetic acid, oxalic acid, malonic acid, maleic acid, lactic acid, glycolic acid, formic acid, benzoic acid, fumaric acid, malic acid and tartaric acid.

12. The method according to claim 1, wherein the effervescing agent is selected and the step of activating the encapsulated effervescing agent is carried out to completion, such that the shaped article with an inflated structure is substantially bereft of encapsulated effervescing agent.

13. The method according to claim 1, wherein the cellulosic dope is regenerated with water.

14. The method according to claim 1, wherein the cellulosic dope is regenerated with an aqueous surfactant composition selected to control the size of the regenerated article.

15. A method of making a wet-laid absorbent sheet comprising:

(a) preparing inflated regenerated fibers by way of (i) preparing a cellulosic dope comprising cellulose dissolved in a suitable ionic liquid or quasi-ionic liquid, (ii) dispersing an effervescing agent in the cellulosic dope, the effervescing agent and ionic liquid or quasi-ionic liquid being selected such that they are substantially inert with respect to each other, (iii) regenerating the cellulosic dope into a fiber comprising a regenerated cellulose matrix having disposed therein substantially unreacted effervescing agent encapsulated by the regenerated cellulose matrix, and (iv) thereafter, activating the encapsulated effervescing agent to generate a gas in-situ within the regenerated cellulose matrix and create a fiber with an inflated structure;

(b) preparing an aqueous furnish incorporating the inflated regenerated cellulose fibers made by step (a) as well as pulp-derived papermaking fibers;

(c) depositing the aqueous furnish on a foraminous support to form a nascent web and at least partially dewatering the nascent web; and (d) drying the web to provide absorbent sheet.

16. The method according to claim 15, wherein the aqueous furnish comprises a pulp derived fiber selected from Kraft hardwood fiber, Kraft softwood fiber, recycle fiber and mixtures thereof.

* * * * *